US006969207B2

(12) United States Patent
Kahl et al.

(10) Patent No.: US 6,969,207 B2
(45) Date of Patent: Nov. 29, 2005

(54) METHOD AND DEVICE FOR RECOGNIZING AN OBJECT ON A SURFACE

(75) Inventors: Dirk Kahl, Preetz (DE); Wolfgang Eberhard Luxem, Kiel (DE); Karlheinz Walter Peter, Molfsee (DE); Sönke Schmidt, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 126 days.

(21) Appl. No.: 10/635,255

(22) Filed: Aug. 6, 2003

(65) Prior Publication Data

US 2004/0226466 A1 Nov. 18, 2004

(30) Foreign Application Priority Data

Aug. 30, 2002 (DE) ..... 102 39 977

(51) Int. Cl.[7] ..... B41J 29/18
(52) U.S. Cl. ..... 400/708; 101/485; 271/263
(58) Field of Search ..... 101/484, 485, 101/486; 271/263; 400/708

(56) References Cited

U.S. PATENT DOCUMENTS 5,531,434 A * 7/1996 Kerschner ..... 271/263

FOREIGN PATENT DOCUMENTS

DE G 82 15 605.0 5/1982 ..... B41F/33/14
EP 0 916 602 A1 5/1999 ..... B65H/7/02

OTHER PUBLICATIONS

IBM Technical Disclosure Bulletin, NN77091623, vol. 20, Issue 4, pp. 1623–1625, Sep. 1977.*

* cited by examiner

*Primary Examiner*—Charles H. Nolan, Jr.
(74) *Attorney, Agent, or Firm*—Lawrence P. Kessler

(57) ABSTRACT

Recognizing a print substrate in the vicinity of a sensor within a printing machine, whereby a change in the capacitance of the system formed by the sensor and a surface of an area in which a print substrate should be recognized, is recognized by the sensor. In this way, print substrates can already be identified on the basis of a dielectric constant that is different from that of air.

6 Claims, 2 Drawing Sheets

METHOD AND DEVICE FOR RECOGNIZING AN OBJECT ON A SURFACE

FIELD OF THE INVENTION

The invention relates to recognizing a print substrate in a printing machine in the vicinity of a sensor.

BACKGROUND OF THE INVENTION

Print substrates, are conveyed within printing machines, by various types of conveying mechanisms. They are carried in this manner to the inking devices and to other devices within the printing machine. The conveyor may be aided by grippers or by suction devices. The conveyor may be carried out with rollers or with conveyor belts. If a print substrate leaves the conveying path provided in the printing machine, it may cause considerable damage within the machine. It may be that at least parts of the print substrate reach the inking device, for example, and cause massive damage therein.

The danger that such defective runs may occur exists in particular with printing machines in which the print substrate is conveyed without grippers. This is the case with digital printing machines, where the print substrate is conveyed via a belt or a roller. The print substrate is held by electrostatic forces or by negative pressure on the belt or on the roller.

It is thus important to prevent the occurrence of defective runs or at least to recognize them in time so that it is still possible to stop the machine or at least prevent it from entering the area endangered by the defective run, before damages occur. This also applies in particular if a sheet-type print substrate is used.

To recognize defective sheets, it is recommended e.g., in EP 0 916 603 A1, to compare the number of sheets fed into the machine with the number of sheets recognized by sensors in the interior of the machine. If the number of sheets in the machine interiors is insufficient, it can be concluded that there are misprints and an alarm is set off and suitable countermeasures are taken. The number of sheets fed in is transmitted by a control signal to the appropriate monitoring devices.

If this device lacks the control signal, e.g., when a machine is restarted, then the recognition of the misprint does not function and it must be switched off for a short period of time during the restart. During this period of time, there is then the danger that unrecognized misprints may cause damages. Naturally, this also applies if other print substrates are used.

In particular, optic sensors are used indirectly, as described in EP 0 916 602 A1, to recognize a defective run. At this point, the print substrate on a conveying mechanism is detected by a change in reflection. By a signal, it is also known at this point when a print substrate should pass the sensor. Thus, if no print substrate is recognized by the sensor at a given point in time, then an alarm is set off and appropriate measures are taken.

Depending on the conveying mechanism and print substrate used, the difference in the reflectivity between print substrate and conveying mechanism may be too small for a normal optic sensor to still be able to detect a difference. This may be caused by dirt on the surface of the conveying mechanism. In this case, a missing print substrate cannot be recognized. For print substrates whose reflectivity approximately matches the reflectivity of the surface of the conveying mechanism, the customary optical sensors are thus relatively unsuitable for recognizing a defective run. At the least, the conveying mechanism must be cleaned regularly.

SUMMARY OF THE INVENTION

It is thus the object of the present invention to disclose a method and apparatus where print substrates, in particular, defective runs of these print substrates in the vicinity of a sensor can be detected, preferably directly, and, to be precise, independent of their reflectivities. Furthermore, another object is to avoid compulsory cleaning of the conveying mechanism to recognize defective run, or to at least lengthen the cleaning intervals between cleanings. According to the invention, the object is achieved, in that a change in the capacitance of the system formed by the sensor and a surface of an area, in which a print substrate is recognized by the sensor. This has the advantage that misdirected print substrates can be positively detected at any time at the specified locations. Since an alarm is set off exactly at the moment that a print substrate is positively detected, there is no longer any possibility that a print substrate existing at these locations is not detected.

The detection in this case is independent from the reflectivities of the print substrate, thus a considerably larger selection of print substrates can be detected, since their reflectivities do not have to be monitored. The same thus applies accordingly for the selection of the existing conveying mechanism.

The fact that a print substrate generally has a dielectric constant that is different from that of air is advantageously used. Therefore, if a print substrate is induced in an electrical field, the capacitance of the system changes. This change is then a direct result of the existence of a print substrate. For this reason, according to the invention, the sensor should be able to recognize the capacitance change and thus also the print substrate on its own. Practically speaking, the sensor itself can be developed as an electrode of the system. Depending at which location inside the printing machine the print substrate is to be recognized, an already available surface, or a surface to be newly inserted in the machine can act as the second electrode of the system. The operating mode of this system of two electrodes, that can generally be optionally developed, is at least similar to the operating mode of a capacitor. The system as such may also be developed as a capacitor.

The print substrate can thus be recognized on each suitable surface within the printing machine. It is thus possible to detect it on a conveying mechanism, such as a conveyor belt or a conveying drum, as well as on existing printing drums or transfer drums. In printing machines that use electrophotographic illustration drums, a print substrate can be verified on its surface, as well as on the surface of an intermediate transfer drum, whereby, depending on the type, toner is directly or indirectly transferred to the print substrate. In offset printing machines or printing machines that use rubber blanket drums as do offset printing machines, the print substrate can be verified on these rubber blanket drums. However, any other positions within the printing machine may also be selected directly, such as an available printing plate or a deflection roller.

When selecting the surface, or with the surface to be inserted, care must be taken that the print substrate to be verified lies between the surface and the sensor. Should the print substrate be recognized on a conveying mechanism, for example, then the conveying mechanism itself, can act as the electrode of the system. The sensor may then be kept ready above the surface of the conveying mechanism. In this manner, any print substrate on the surface of a conveying mechanism can be recognized. Advantageously, the different reflectivities of surface and print substrate do not matter with this electronic method. Even with a dirty surface, the print substrate can still be properly detected.

The use of a newly inserted surface as the second electrode is then advantageous if there are reasons for not using an already existing surface as an electrode. The newly inserted surface can thus be situated at any location, or at least in the vicinity, where a print substrate should be recognized. In order for the sensor and the surface to be used as electrodes, according to the invention, a voltage is applied between these areas. In this manner, only the capacitance of the system thus formed can be recognized in an easy way. According to the invention, a print substrate is recognized only after a change in capacitance that exceeds a specified value.

The change in capacitance of a capacitor can be recognized by the change in the voltage between both electrodes. Thus, according to the invention the voltage between the sensor and a comparison electrode is measured. This comparison voltage, for example, may be the potential of the surface on which the print substrate should be recognized. According to the invention, the ground, i.e., a constant potential, is used as the reference potential. If the voltage between the electrodes changes, then this can also be detected by a change in the voltage between the sensor and the reference potential.

According to this invention, it is possible to easily assess the change in voltage. It is not necessary to know the absolute capacitance of the system; all that is required is that the relative change in potential between the electrodes be recognized. From a certain threshold value, which is necessary for changes in voltage, the other possible causes, such as humidity, must be excluded; then it becomes possible to deduce with certainty that a print substrate is present.

According to the invention, it is further envisaged that the current flowing through the sensor should be measured, as an additional procedure or also as a separate procedure. If the capacitance of the system now changes due to a print substrate between the two electrodes, then the stored amount of charge changes. As a result, a current flow flows through the sensor. In order to take into account fault tolerances, it is thus simply sufficient to monitor the current flowing through the sensor and, starting with a current flow that lies above a threshold value, to deduce that a print substrate has entered or exited the sensor area.

In an advantageous further development according to the invention, a charged wire is provided in the area around the surface as a sensor. In this manner, the surface can be monitored with the sensor over a length that corresponds to the length of the wire at the same time, and any potential defective run can be discovered there, even if the print substrate does not cover the total width of the surface. Furthermore, an existing wire that is already in the area surrounding the surface can also be used, such as a wire in a pre-cleaner to dissolve toner particles from the surface of a rubber blanket drum.

The object of the invention is achieved by at least one electric sensor in the vicinity surrounding a surface of an area inside the printing machine, in which a print substrate is to be recognized. In this way, it is advantageously possible to recognize a print substrate not only in the area surrounding the conveying mechanism, but also in areas outside the conveying path and thus to determine either indirectly or directly that there is a defective run. According to the invention, this avoids the disadvantages of optical sensors. The electric sensors can be kept ready in certain areas or operate over the entire width of the print substrate.

In an advantageous enhancement of the device, at least one part of an electric sensor has an electric voltage deviating from that of the surface. The sensor and the surface then form a capacitor, whose capacitance is set as a function of a possible dielectric in the gap between the sensor and the surface. A print substrate can then be recognized by a change in capacitance.

As a result, it is advantageously possible to directly identify a defective run; it is preferable to keep the sensor ready outside the path of the print substrate provided, preferably in the area around a rubber blanket drum. In this manner, a defective run of the print substrate can be directly prevented in the area where considerable damage could also be caused. This applies in particular to the use of this device within a digital printing machine, in which the rubber blanket drum forms the connection between the inking system and the print substrate. At this point, a misdirected print substrate can thus first be advantageously recognized, and timely measures can still be taken to avoid damages.

In digital printing machines, a charged wire may already be available in the area around a rubber blanket drum, which is to be used here as a so-called pre-cleaner to loosen toner particles on the charged drum. This is achieved by applying a high voltage between the wire and the roller. It can advantageously be that this charge wire is simultaneously used as a sensor to recognize a defective run. It is not necessary to integrate an additional electrode in the printing machine. By measuring the amperage through this wire or the voltage between the wire and the ground or another reference voltage, the existence of print substrate in the area around the charged wire can be concluded as described above. Since the wire is located in the area surrounding a rubber blanket drum, the existence of a misdirected print substrate in the area surrounding this rubber blanket drum can thus be directly concluded. Practically speaking, an alarm should then be triggered automatically and suitable measures should be initiated to prevent damages.

With the embodiments described, the sensor can be provided both in the area surrounding conveying mechanism as well in areas in the printing machine that lie outside the path of the print substrate provided. In the first instance, the existence of print substrate on the conveying mechanism can be verified. By a comparison with a corresponding control signal, it can be assessed whether a print substrate fed into the machine is no longer present. This may be the case, for example, if no print substrate at all is observed at a certain point in time. In this case, it can be concluded that there is a defective run of the print substrate, and suitable measures can be initiated. The advantage is that this arrangement is independent of the reflectivities of the print substrate and the conveying mechanism. Furthermore, cleaning the conveying mechanism just for better recognition of the print substrate is essentially no longer necessary.

There is the possibility of installing a second electrode on the side of the conveying path that is turned away from the sensor, thus making it possible to then recognize the existence of the print substrate. This may be necessary if the already existing surface is not considered as the electrode or the conveyance of the print substrate takes place directly in the air, e.g., on an air cushion.

In the second instance, the sensor must be provided outside the path of the print substrate, e.g., in the area of a transfer drum, e.g., of a rubber blanket drum, or in another area of a printing unit in which no print substrate arrives. The transfer drum itself can then serve as the second electrode of the capacitor. It is in this manner that a print substrate can then be immediately recognized in this area, whereupon an alarm is triggered and suitable measures can take place to prevent damages. This is independent of any control signals, since a defective run can be recognized directly.

With the invention as described, it may also be possible to recognize, at least partially, the tearing in a paper web at an early stage.

BRIEF DESCRIPTION OF THE DRAWINGS

Other embodiments, in which other inventive characteristics may be disclosed, to which the scope of invention is not limited, however, are illustrated in the drawings. Shown are.

DETAILED DESCRIPTION OF THE INVENTION

Figure 1:
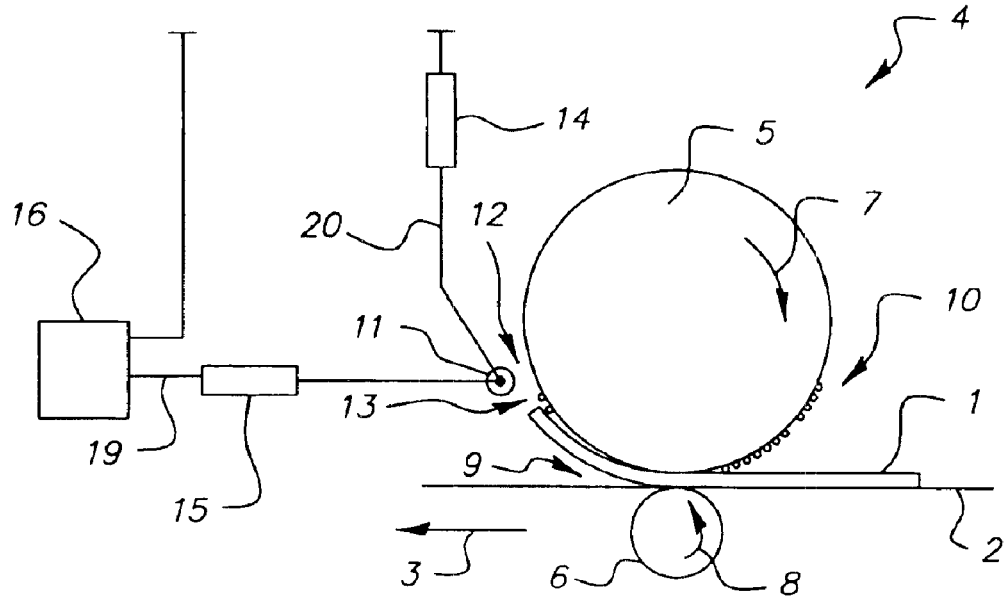
FIG. 1 is a schematic view, in cross-section, of a printing unit with a rubber blanket drum.

The cross-section of a printing unit with a rubber blanket drum is pictured in FIG. 1. Such printing units are used, e.g., in digital printing machines. A print substrate 1 is carried through the printing unit 4 on a conveyor belt 2 in direction 3. The printing unit 4 includes a photoelectric drum that is not shown, a rubber blanket drum 5 and the printing drum 6, as well as other illustration drums and inking devices that are not shown herein. The rubber blanket drum 5 rotates during the conveyance of the print substrate in direction 7 and the printing drum 6 in direction 8. Print substrate 1 is carried by conveyor belt 2 through nip 9 between the rubber blanket drum 5 and printing drum 6, where the illustration of print substrate 1 takes place with a toner 10, which is located on the surface of the rubber blanket drum 5.

The toner reaches the rubber blanket drum 5 via the photoelectric drum. In the rotating direction 7 behind nip 9, an electric sensor 11 is located in the area of the rubber blanket drum 5. If a print substrate 1 deviates from the conveying path provided in direction 3, arriving thus in a position 12 between the sensor 11 and the rubber blanket drum 5, then print substrate 1 is recognized by sensor 11.

Toner 10 is held on rubber blanket drum 5 by electrostatic forces, until it is transferred in nip 9 to print substrate 1, supported by printing drum 6, which may also be charged for this purpose. Following this transfer, toner residue 13 may still be found on rubber blanket drum 5, which is subsequently completely removed with a cleaning unit not shown herein. In order to facilitate this removal, sensor 11 is developed as a charging wire. A voltage of several kV is built up between rubber blanket drum 5 and sensor 11. Toner 10 is generally negatively charged and is held on the surface of rubber blanket drum 5 by positive charges. These positive charges are generated so selectively at specified points, that the image to be produced is latently composed by toner 10 on the surface of the rubber blanket drum. Since both the toner residue 13 and the rubber blanket drum 5 are charged, the toner residue 13 is largely discharged by the electric field lying between sensor 11 and rubber blanket drum 5 and thus is at least loosened to the extent, that it can be easily removed by the cleaning unit from the surface of the rubber blanket drum 5.

Figure 2A:
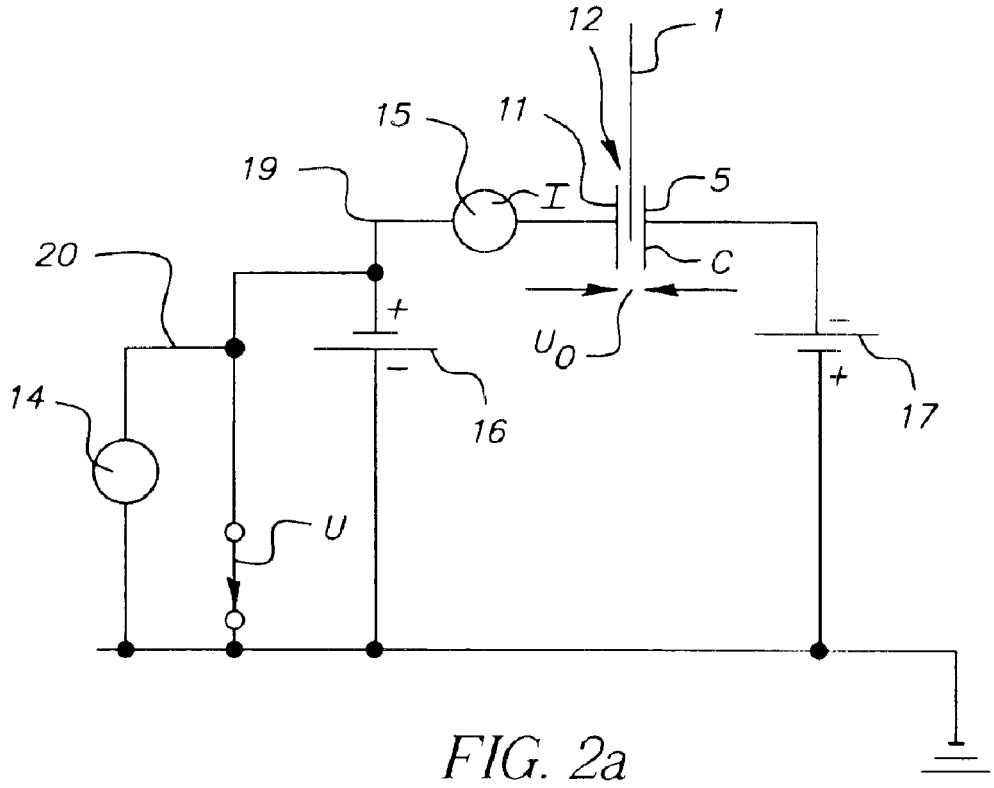
FIGS. 2*a* and 2*b* are equivalent circuit diagrams of a device for recognizing a print substrate in a printing machine.
Figure 2B:
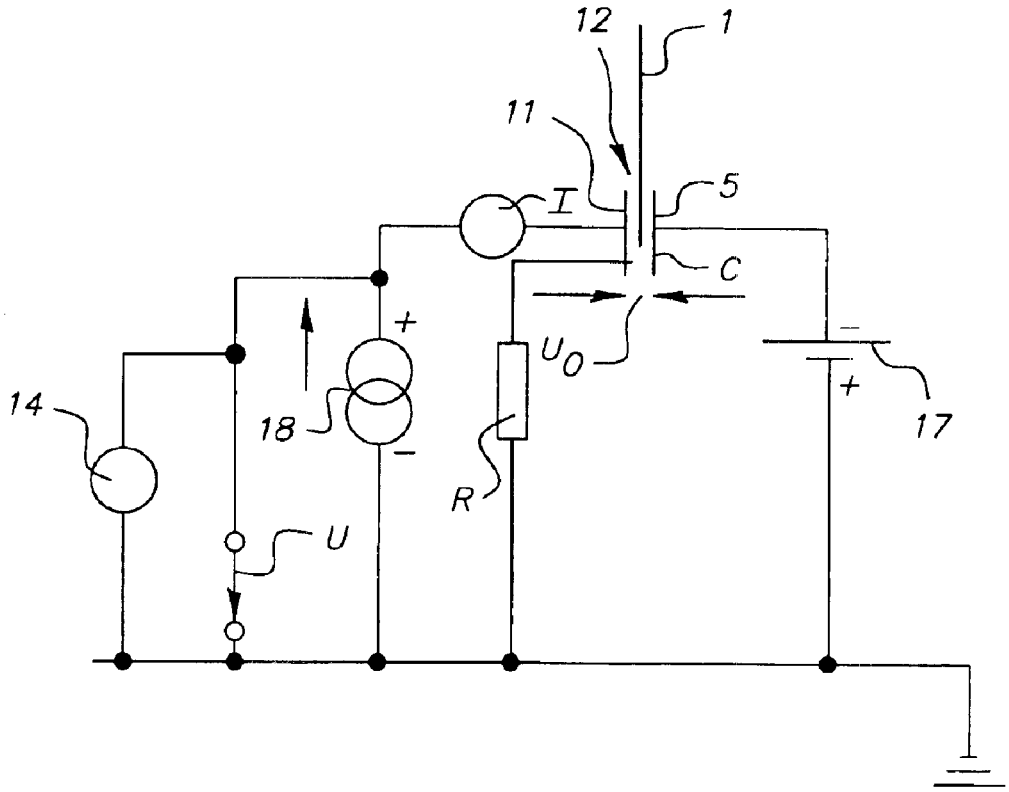

The combination of sensor 11 and the surface of rubber blanket drum 5 acts as capacitor C, with sensor 11 and rubber blanket drum 5, being the two electric electrodes of capacitor C (see FIGS. 2*a* and 2*b*). Sensor 11 is connected to an ammeter 15 and a voltmeter 14 via lines 19, 20. Sensor 11 via line 19 with a voltage supply 16 generates a voltage between sensor 11 and the surface of rubber blanket drum 5. By the voltmeter 14 or the ammeter 15, a voltage change between sensor 11 and rubber blanket drum 5 can be recognized, i.e., a current change that goes through sensor 11. A change such as this one may occur as the result of the print substrate 1 leaving the conveying path and now moving into position 12. This then changes the capacitance of capacitor C, since now a dielectric is provided, which is the print substrate 1 in the gap between sensor 11 and rubber blanket drum 5.

In this manner, a misdirected print substrate in the area of the rubber blanket drum 5 can thus be recognized by ammeter 15 or voltmeter 14. An alarm can then be triggered via an alarm device that is not shown, and the printing machine, or at least the printing unit 45 can be stopped. This can prevent the print substrate 1 from proceeding further into the cleaning unit or in the inking system not shown herein.

FIGS. 2*a* and 2*b* each show an equivalent circuit diagram of a device for recognizing a defective run within a printing machine. These figures are illustrations of a circuit. When the print substrate 1 leaves the paper path 3 provided, it subsequently arrives in the gap 12 between rubber blanket drum 5 and sensor 11. Rubber blanket drum 5 and sensor 11, act here as the two electrodes of capacitor C. A voltage $U_0$ is built up between rubber blanket drum 5 and sensor 11 via both voltage supplies 16 and 17. A current source 18 can also be used for this purpose, in particular for sensor 11. According to FIG. 2*b*, sensor 11 may be brought to a strongly negative voltage against the rubber blanket drum 5 by this current source. For this purpose, a resistance R was accepted in the equivalent circuit diagram. This resistance R can also be the wire itself; however, it may also be especially built into the circuit.

Changes in the capacitance of capacitor C can be detected via ammeter 15 and/or voltmeter 14. It can be that both meters are only used individually. Preferably, in the event of a configuration as shown in FIG. 2*b*, solely voltmeter 14 should be used for recognizing a change in the capacitance of capacitor C. According to FIG. 2*b*, a preferred arrangement is provided in which the voltage of sensor 11 is set up by current source 18 and a change in the capacitance of capacitor C takes place solely via voltmeter 14. Now if print substrate 1 advances into position 12, thus changing the capacitance of capacitor C, which is reflected in a change in the voltage U at voltmeter 14. If the change exceeds a predetermined threshold value, an alarm can be triggered via an alarm device that is not shown, and suitable measures can be taken to protect the machine.

For an the arrangement as illustrated in FIG. 2*a*, a corresponding alarm is also triggered and further measures are also initiated by a change of current I measured by the ammeter 15. A threshold value can also be set in this case, which the current change must exceed to trigger the alarm.

It can also be provided that both the measured current I, as well as the measured voltage U, must change by a predetermined amount to trigger the alarm. As another alternative, a single change in voltage U can also be determined by voltmeter 14, if the prevailing voltage between sensor 11 and rubber blanket drum 5 is generated by voltage supply 16.

In another possible embodiment, it can also be provided that it is not the amount of the voltage or current changes that are controlled for triggering an alarm, but the magnitude of voltage U and/or current I themselves serve as parameters for triggering an alarm. Regarding the structure pictured, nothing changes to the extent that the measured voltage U and/or the measured current 1, each for themselves, or simultaneously, must exceed a predetermined value so that an alarm is triggered and the printing machine, or at least printing unit 4, are shut down.

Figure 3:
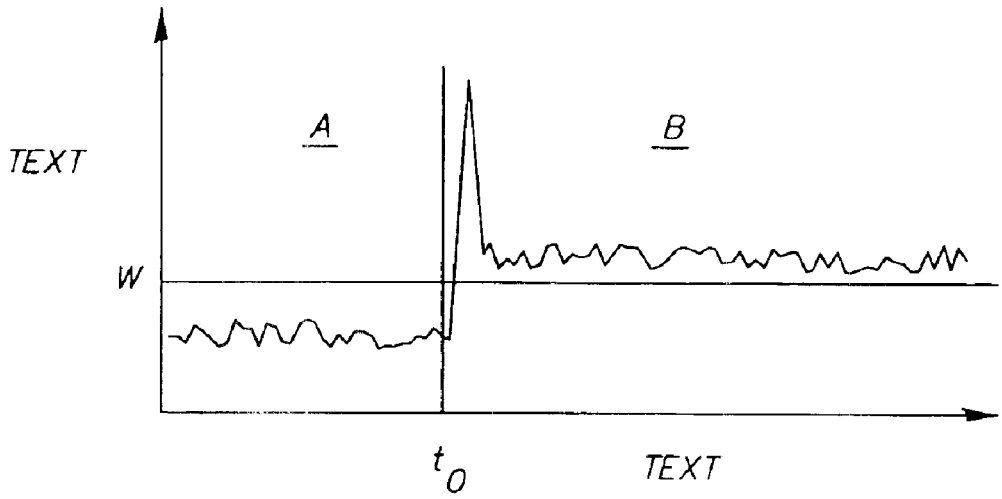
FIG. 3 is a qualitative diagram of a measured signal run with a defective run occurring during a measuring period.

A qualitative change of voltage U or current I is illustrated in FIG. 3. The ordinate can represent both a voltage U measured by the voltmeter 14 as well as a current I measured by ammeter 15. These measuring values are generally designated as signals. The x-coordinate expresses a temporal run, in which print substrate 1 comes into position 12 at a point in time $t_0$. Within area A, no print substrate 1 is located outside the conveying path 3, and within area B, a print substrate 1 is located within position 12. Both the x-coordinate values as well as the ordinate values are each expressed in arbitrary units (a.U.). If a threshold value W is exceeded, then an alarm can be triggered and the machines shut down.

With the arrangement and method illustrated herein, it is possible to directly identify a defective run in the area surrounding a rubber blanket drum 5. If print substrate 1 deviates from the path 3 provided, when print substrate 1 arrives in position 12, a voltage or current change is recognized. As a result, an alarm is triggered and measures are taken to protect the machine, e.g., the machines can be shut down or at least the rubber blanket drum 5 can be stopped.

The invention has been described in detail with particular reference to certain preferred embodiments thereof, but it will be understood that variations and modifications can be effected within the spirit and scope of the invention.

What is claimed is:

1. A device for recognizing a print substrate in the vicinity of a sensor (11) within a printing machine, including a rubber blanket drum, comprising: at least one electric sensor (11) in the vicinity of a surface area of said rubber blanket drum, upon which a print substrate should be recognized, and a circuit connected to said at least one electric sensor (11), said circuit kept ready so as to recognize a change in capacitance due to the print substrate being in the vicinity of said at least one electric sensor.

2. The device according to claim 1, wherein said circuit includes a voltage applied between the sensor (11) and the surface of an area of said rubber blanket drum.

3. The device according to claim 1, wherein a current flow is measured by said sensor (11).

4. The device according to claim 1, wherein said sensor (11) is a charged wire in the vicinity of the surface of an area of said rubber blanket drum.

5. The device according to claim 1, wherein at least one part of said electric sensor (11) has an electric voltage that deviates from that of the surface of the area of said rubber blanket drum.

6. The device according to claim 1, wherein said sensor (11) is a charging wire.

* * * * *